US006749074B1

(12) United States Patent
Hileman et al.

(10) Patent No.: US 6,749,074 B1
(45) Date of Patent: Jun. 15, 2004

(54) SPORTS EQUIPMENT STORAGE DEVICE

(75) Inventors: John Hileman, North Lima, OH (US); Budd Brothers, Canfield, OH (US)

(73) Assignee: Budd R. Brothers, Canfield, OH (US)

( * ) Notice: Subject to any disclaimer, the term of this patent is extended or adjusted under 35 U.S.C. 154(b) by 0 days.

(21) Appl. No.: 10/271,036

(22) Filed: Oct. 15, 2002

(51) Int. Cl.[7] ..... A47F 7/00
(52) U.S. Cl. ..... 211/85.7; 211/60.1
(58) Field of Search ..... 211/85.7, 70.6, 211/60.1, 66, 13.1, 14, 94.01, 94.02

(56) References Cited

U.S. PATENT DOCUMENTS 3,698,563 A 10/1972 Gordon et al.
4,049,126 A 9/1977 Halverson
4,193,495 A 3/1980 Keeley
4,583,647 A * 4/1986 Schinzing ..... 211/60.1
5,617,958 A * 4/1997 Laug et al. ..... 211/85.7
5,626,244 A * 5/1997 Mesna et al. ..... 211/60.1
5,690,235 A * 11/1997 Matzen ..... 211/85.7
5,740,927 A * 4/1998 Yemini ..... 211/70.6
5,853,092 A * 12/1998 Goodman et al. ..... 211/70.6

* cited by examiner

*Primary Examiner*—Daniel P. Stodola
*Assistant Examiner*—Khoa Tran
(74) *Attorney, Agent, or Firm*—Harpman & Harpman

(57) ABSTRACT

A portable rack for arranging and storing baseball bats, balls, batting hats and related baseball equipment. The storage rack is supported on a wall surface with extensible and pivotal deployable equipment engaging extensions for receiving baseball equipment. Clip assemblies allow for selective attachment and removal from a wall-supporting surface.

11 Claims, 7 Drawing Sheets

SPORTS EQUIPMENT STORAGE DEVICE

BACKGROUND OF THE INVENTION

1. Technical Field

This invention relates to sports equipment storage and specifically for baseball equipment holders that can be easily transported to the game field and used to organize and store the equipment associated with the sport.

2. Description of Prior Art

A number of prior art devices have been developed for the storage of baseball equipment which is an important issue in organized play such as Little League, high school and college teams. Each baseball team must have an assortment of related equipment including bats, batting helmets, gloves and baseballs. Proper storage of such equipment during game play is important for both ease of use and safety reasons. Bats in particular are a safety concern since a number of bats lying around on the ground can easily be tripped over or walked on.

In U.S. Pat. No. 3,698,563 a baseball storage rack is disclosed having a plurality of bat retaining members extending from a ball storage box with a plurality of upstanding hooks for gloves and the like.

U.S. Pat. No. 4,049,126 is directed to a foldable bat storage rack which has a pair of shelf-like bat supports pivoted together and hung from a fence by multiple wire hangers. Each of the bat supports are rectangular elements having a plurality of longitudinally spaced notches therein to accept baseball bats by their handles.

U.S. Pat. No. 4,193,495 claims a portable sports equipment organizer having a pair of rectangular support panels hinged together with a number of bat clips mounted on their outer surfaces.

SUMMARY OF THE INVENTION

The present invention relates to a portable baseball equipment rack having fixed brackets for the storage of bats and balls with a pair of extensible bars which can be deployed on which a plurality of hooks extend for storage of batting hats and equipment. Additional hat and equipment holders are available by a pair of pivotally secured arms extending from the respective ends of the rack and swing down to a vertical position for use with multiple hooks on each arm.

DESCRIPTION OF THE PREFERRED

Figure 1:
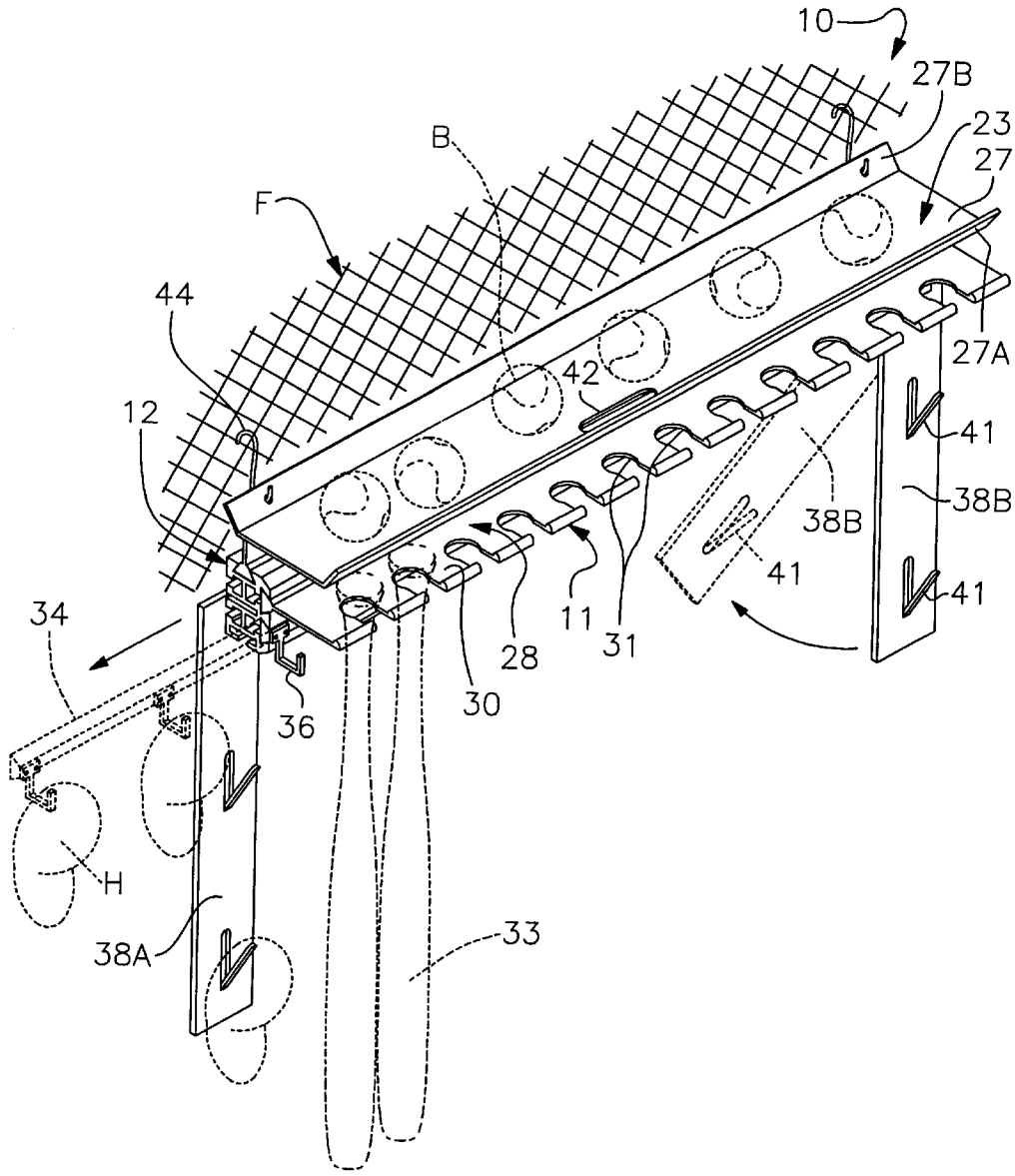
FIG. 1 is a perspective view of the equipment rack in partial open use position.
Figure 2:
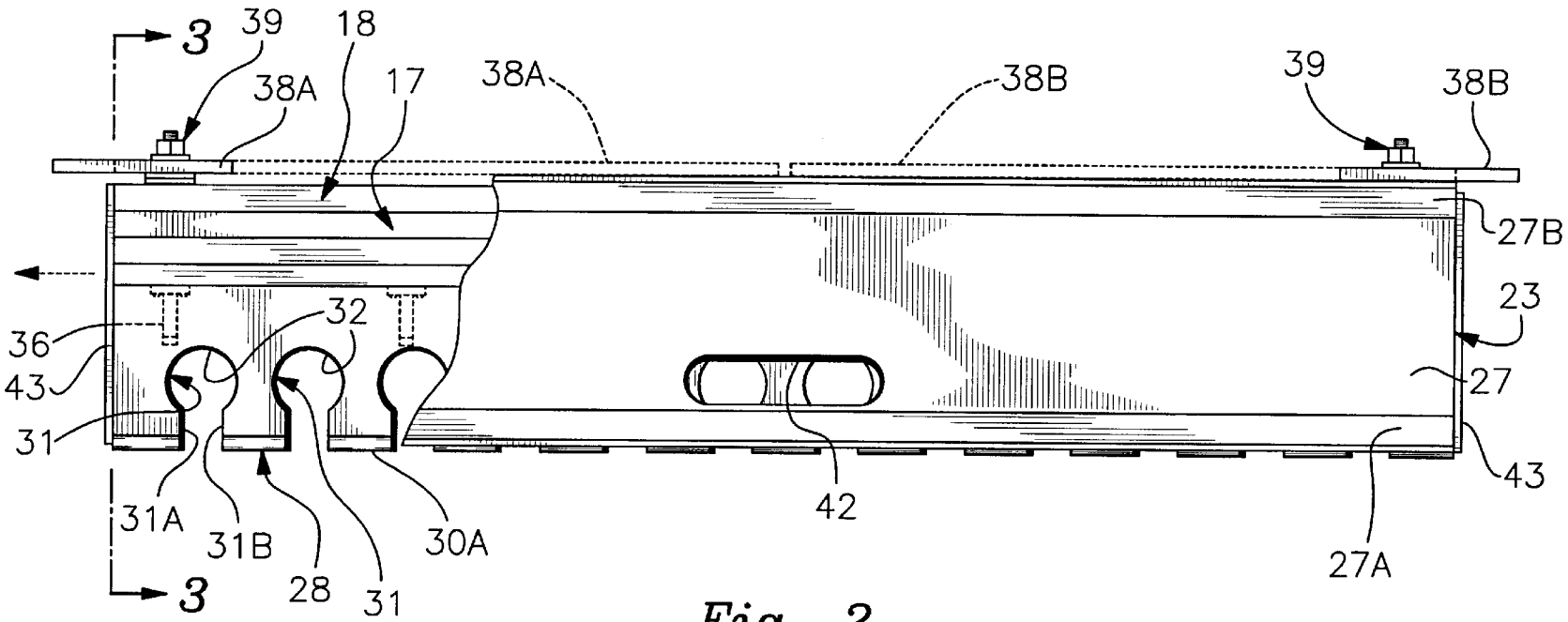
FIG. 2 is a top plan view of the equipment rack.
Figure 4:
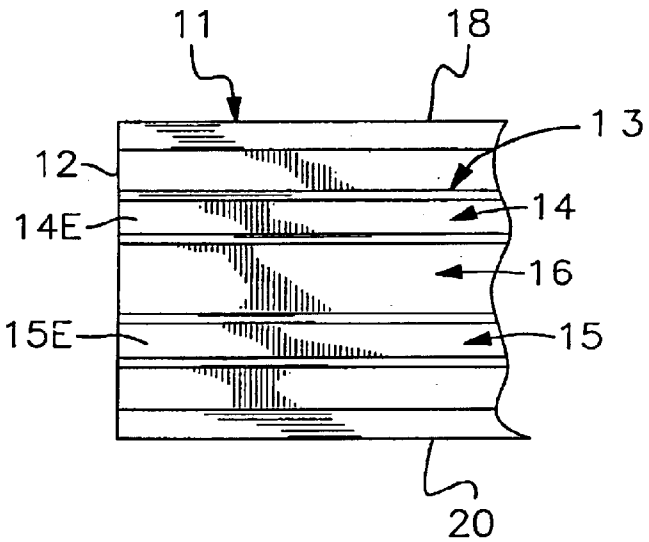
FIG. 4 is a partial front elevational view of the main extrusion member from which the equipment rack is based.
Figure 3:
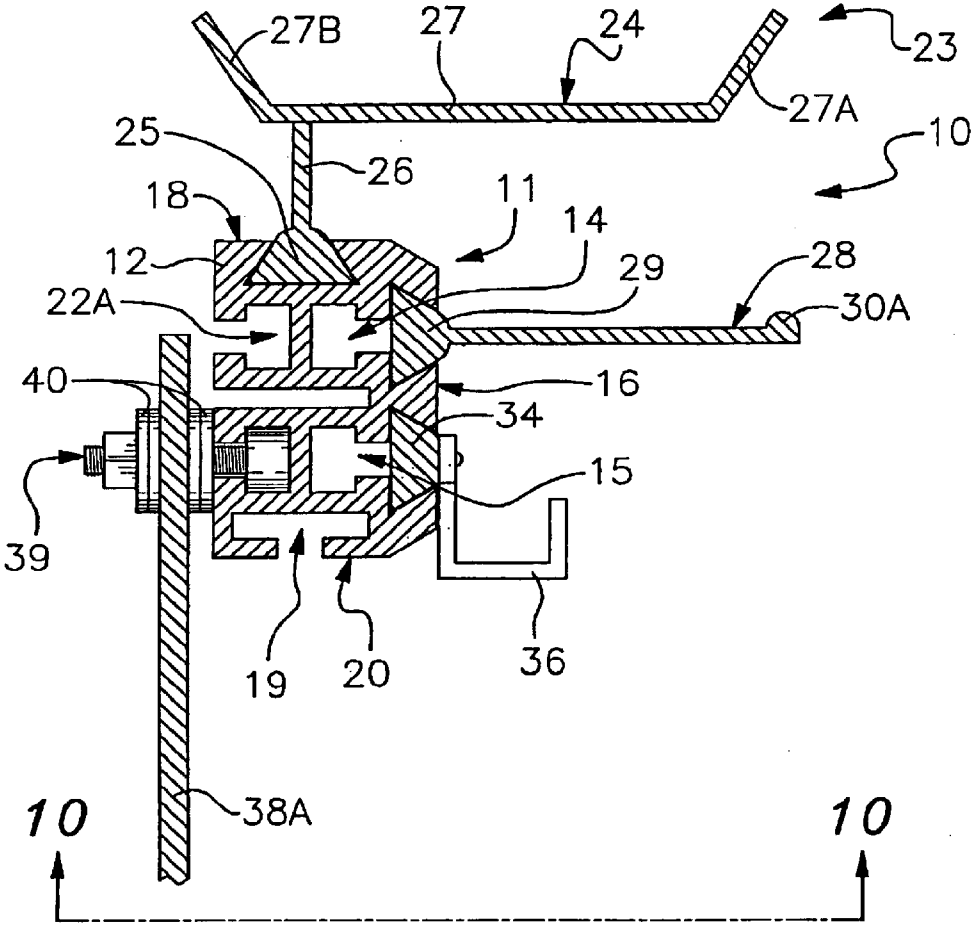
FIG. 3 is an enlarged cross-sectional view on lines 3—3 of FIG. 2.
Figure 12:
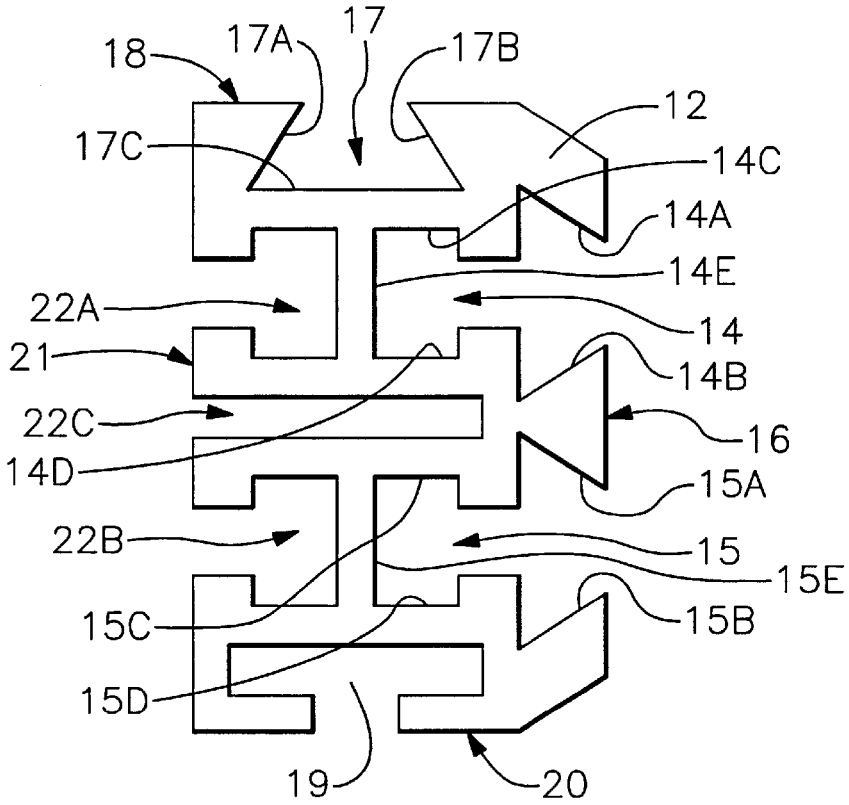
FIG. 12 is an end elevational view of the extrusion on which the equipment holder is based.

Referring to FIGS. 1–3 of the drawings, a baseball equipment holder 10 can be seen having a main body member 11 made up of an elongated single aluminum extrusion 12, best seen in FIGS. 3 and 12 of the drawings. The extrusion 12 has a plurality of mounting channels 13 formed therein. A pair of vertically spaced channels 14 and 15 define the front face 16 of the extrusion 12. Each of the channels 14 and 15 have oppositely disposed tapered top and bottom surfaces 14A and 14B and 15A and 15B with respective. oppositely disposed horizontal multiple wall surfaces 14C and 14D and 15C and 15D with respected back walls 14E and 15E to complete each channel configuration. A mounting channel 17 defines a top surface 18 of the holder 10 having oppositely disposed tapered sidewalls 17A and 17B and interconnecting bottom wall 17C.

A channel 19 defines the bottom surface 20 of the equipment holder 10 as best seen in FIG. 3 of the drawings. A back surface 21 of the extrusion 12 has a pair of vertically spaced identical channels 22A and 22B which are separated by a single structural channel 22C that extends into the extrusion 12.

Referring now to FIG. 3 of the drawings, a ball holder 23 is secured within the top surface 18 and is formed and elongated extrusion member 24 having an engagement base bar 25 registerable within the channel 17. A support bar portion 26 extends integrally there from with a right angularly disposed ball-receiving platform 27. The ball platform 27 has transversely spaced opposing angularly offset upstanding flanges 27A and 27B extending there from.

Referring now to FIGS. 1, 2, 6 and 10 of the drawings, a bat retaining bracket 28 is secured within the channel 14 having a channel conforming base portion 29 with an integrally extending bat receiving platform 30. The bat-receiving platform 30 has a plurality of longitudinally spaced contoured notches 31 extending inwardly from a beaded edge surface 30A. Each of the notches 31 has spaced parallel side edges 31A and 31B interconnected by an arcuate edge surface 32 which will conform with a portion of a baseball bat 33 as illustrated in dotted lines positioned within the bat retaining bracket 28 in FIG. 1 of the drawings.

Figure 9:
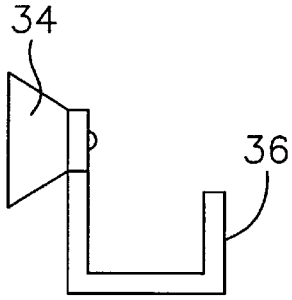
FIG. 9 is an enlarged side elevational view on lines 9—9 of FIG. 8.
Figure 13:
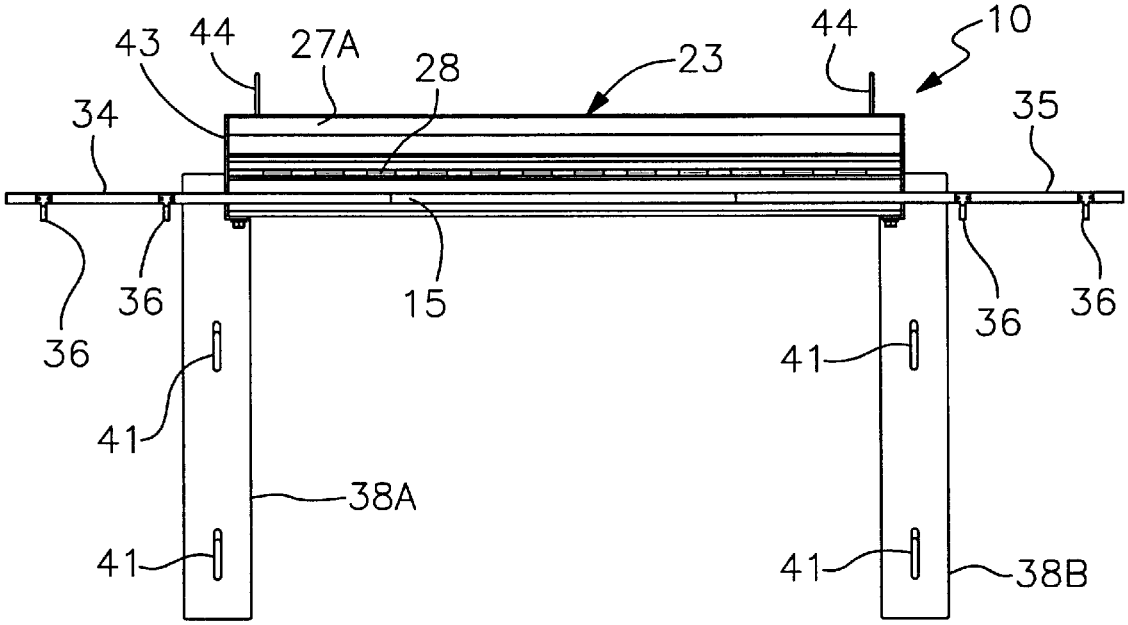
FIG. 13 is a front elevational view of the equipment holder in deployed position ready for use.

A pair of hat storage support rods 34 and 35 are respectively slidably disposed within half of the channel 15. Each of the rods 34 and 35 therefore have a plurality of hooks 36 secured in spaced longitudinal relation to one another as best seen in FIGS. 1, 3 and 13 of the drawings. Each of the hooks 36 have a T-shaped base which is adapted so as to be secured to a front surface 37 of the respective rods 34 and 35 and each has a pair of integrally right angled arms defining a J-shaped configuration on each of the hooks 36 as best seen in FIG. 9 of the drawings.

The rods 34 and 35 are of equal length and are selectively extended outwardly from oppositely disposed ends of the channel 15.

A pair of hat supporting arms 38A and 38B are secured to the channel 22B inwardly of its respectively ends by a threaded nut and bolt assembly 39. Multiple spacer washers 40 on the bolt assembly 39 provide a bearing surface for the respective arms 38A and 38B. It will be noted that the arms 38A and 38B are pivotally engaged off of its transverse center inwardly of one end so that when folded up against the extrusion 12 a portion of each of the arms will be extending down beyond the bottom surface 19 as illustrated in broken lines in FIG. 2 of the drawings. A pair of integral hooks 41 are formed in each of the arms and act as stops therefore when the arms are folded as hereinbefore described.

A handle opening at 42 is formed in the base 27 of the ball holder 23 adjacent the angular upstanding flange 27A midway its overall length.

Figure 5:
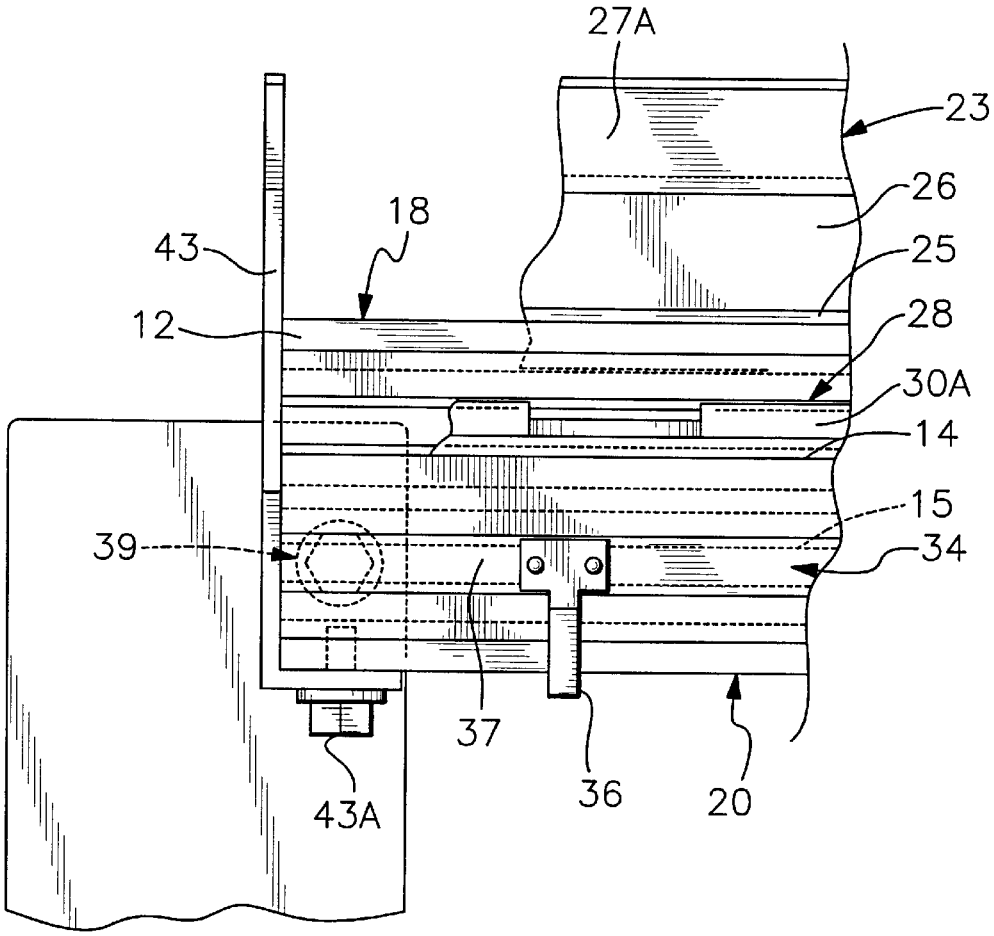
FIG. 5 is an enlarged partial front elevational view of the equipment rack with portions broken away.
Figure 6:
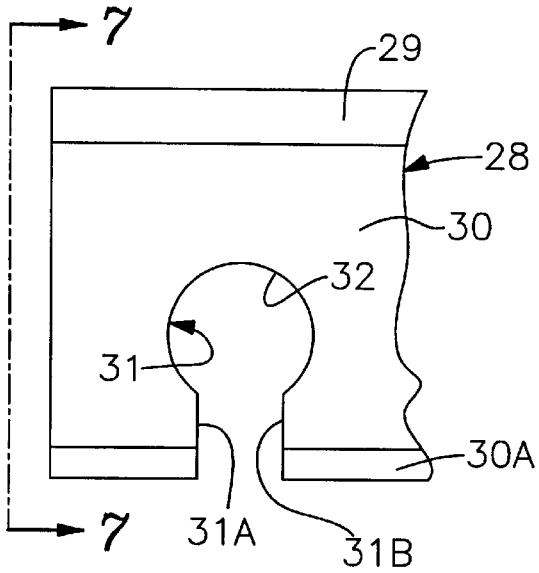
FIG. 6 is a partial top plan view of the bat holder bracket portion.
Figure 7:
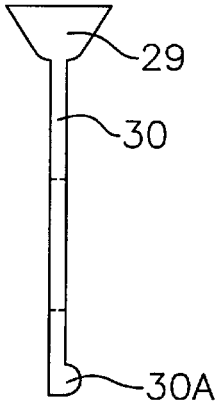
FIG. 7 is a side elevational view on lines 7—7 of FIG. 6.
Figure 8:
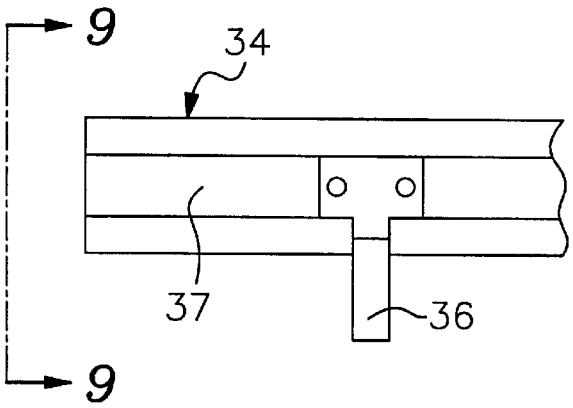
FIG. 8 is an enlarged partial front elevational view of the extensible hat holding bars.
Figure 10:
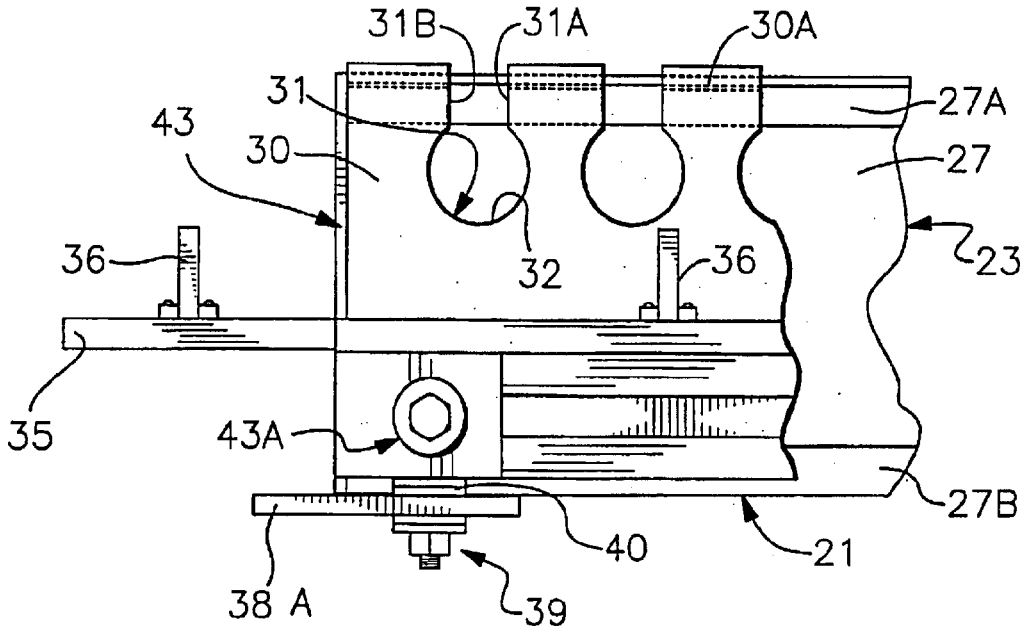
FIG. 10 is an enlarged partial bottom plan view of the equipment holder.
Figure 11:
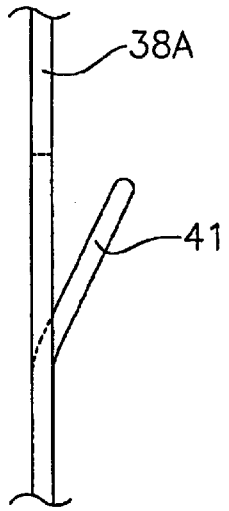
FIG. 11 is an enlarged partial side elevational view of a hook on the pivoted arms.

End caps 43 extend over the respective ends of the extrusion 12 enclosing all of the channels 13 except that for channel 15 as noted and best seen in FIGS. 2, 5 and 10 of the drawings.

It will be evident that during use the baseball equipment holder 10 of the invention is hung from a support surface such as a chain link fence F by a pair of hook elements 44. Once positioned, the hat support rods 34 and 35 are extending horizontally from either end of the channel 15. The hat and equipment support arms 38A and 38B arc pivotally deployed to vertical position as best seen in FIG. 13 of the drawings. Once set up, the equipment holder 10 of the invention can support a number of baseball bats 33, batting hats H as shown in dotted lines in FIG. 1 of the drawings and baseballs B shown in dotted lines being placed within the ball holder 23.

It will be noted that the respective end caps 43 also extend upwardly beyond the top surface 18 of the extrusion 12 and are engaged over portions of the open ends of the ball holder 23 acting as retaining walls so as to confine balls B placed therein. The end caps 43 are secured to the extrusion 12 by a fastener assembly 43A engageable into the bottom channel 19 as best seen in FIGS. 5 and 10 of the drawings.

It will thus be seen that a new and useful portable baseball equipment holder has been illustrated and described and it will be apparent to those skilled in the art that various changes and modifications may be made therein without departing from the spirit of the invention.

We claim:

1. A portable storage rack for baseball equipment comprises in combination, an elongated extrusion having a plurality of registering channels within, a bat retaining member registerable within one of said channels, a ball holder registerable within one of said channels, a pair of hanger support bars slidably secured within one of said channels, a pair of hanger support arms pivotally secured to said extrusions, said bat retaining member having a plurality of longitudinally spaced contoured notches within, said ball holder having an elongated base with oppositely disposed upstanding elongated parallel upstanding flanges, means for pivotally deploying said arms laterally from said bat holder, and means for selectively securing said storage rack to a supporting surface and means for preventing displacement of said bats laterally from within said bat retaining member.

2. The portable storage rack set forth in claim 1, wherein said hanger support bars have a plurality of longitudinally spaced hooks secured thereto.

3. The portable storage rack set forth in claim 1 wherein said hanger support arms have multiple hooks extending there from.

4. The portable storage rack set forth in claim 1 wherein said hanger support arms are movable from a first position parallel with said extrusion, to a second position positioned at right angles thereto.

5. The portable storage rack set forth in claim 1 wherein said extrusion has a pair of oppositely disposed end caps secured thereto.

6. The portable storage rack set forth in claim 5 wherein said end caps extend beyond said extension defining retainer walls for said ball holder.

7. The portable storage rack set forth in claim 1 wherein said hanger support arms have a plurality of equipment hooks formed therein.

8. The storage rack set forth in claim 1 wherein means for preventing displacement of said bats laterally comprises a contoured upstanding elongated lip on said bat holder between said respective notches.

9. The portable storage rack set forth in claim 1 wherein said bat retaining member extends laterally from said extrusion in spaced relation to said ball holder and said hanger support arms.

10. The portable storage rack set forth in claim 1 wherein said means for selectively securing said storage rack to a support wall comprises, hooks extending from one of said ball support flanges.

11. A portable storage rack set forth in claim 1 wherein said horizontal support bars are a respective length equal to one-half that of said extrusion's known length.

* * * * *